United States Patent [19]

Greenway et al.

[11] 4,323,760

[45] Apr. 6, 1982

[54] METHOD AND APPARATUS FOR TEMPERATURE CONTROL OF HEATED FLUID IN A FLUID HANDLING SYSTEM

[75] Inventors: John M. Greenway; Don M. Bylund, both of Spartanburg, S.C.

[73] Assignee: Milliken Research Corporation, Spartanburg, S.C.

[21] Appl. No.: 103,255

[22] Filed: Dec. 13, 1979

[51] Int. Cl.[3] ..... H05B 1/00; D06C 29/00; D06C 23/00

[52] U.S. Cl. ..... 219/364; 26/2 R; 219/367; 219/388

[58] Field of Search ..... 219/364, 367, 376, 477, 219/323, 388; 26/2 R; 69/28; 34/48, 83, 232

[56] References Cited

U.S. PATENT DOCUMENTS

| | | | |
|---|---|---|---|
| 1,603,723 | 10/1926 | Stetten . | |
| 1,889,902 | 12/1932 | Moore . | |
| 2,110,118 | 3/1938 | Robertson et al. . | |
| 2,119,057 | 5/1938 | Richa | 223/51 |
| 2,241,222 | 5/1941 | Sonnino | 26/2 |
| 2,563,259 | 8/1951 | Miller | 117/9 |
| 2,723,937 | 11/1955 | Rice | 154/106 |
| 3,010,179 | 11/1961 | Thal | 28/72 |
| 3,214,819 | 11/1965 | Guerin | 28/72.2 |
| 3,353,225 | 11/1967 | Dodson, Jr. et al. | 19/161 |
| 3,357,074 | 12/1967 | Allman et al. | 28/1 |
| 3,403,862 | 10/1968 | Dworjanyn | 239/566 |
| 3,434,188 | 3/1969 | Summers | 28/72.2 |
| 3,448,501 | 6/1969 | Buzano | 28/72 |
| 3,452,412 | 7/1969 | Allman, Jr. et al. | 28/72 |
| 3,458,905 | 8/1969 | Dodson, Jr. et al. | 19/161 |
| 3,494,821 | 2/1970 | Evans | 161/169 |
| 3,508,308 | 4/1970 | Bunting et al. | 28/72.2 |
| 3,585,098 | 6/1971 | Truscott et al. | 161/63 |
| 3,613,186 | 10/1971 | Mazzone et al. | 26/2 R |
| 3,750,237 | 8/1973 | Kalwaites | 19/161 P |
| 4,002,013 | 1/1977 | Johnson et al. | 57/22 |

FOREIGN PATENT DOCUMENTS

| | | | |
|---|---|---|---|
| 2365760 | 12/1978 | France | 219/367 |

*Primary Examiner*—B. A. Reynolds
*Assistant Examiner*—Bernard Roskoski
*Attorney, Agent, or Firm*—H. William Petry; George M. Fisher

[57] ABSTRACT

A method and apparatus is disclosed for maintaining uniform temperature in a pressurized, heated fluid which is distributed from an elongate manifold in at least one pressurized stream. Associated with each of a plurality of inlet conduits is a separate heater unit and temperature sensing means, as well as an individual metering valve, for heating and adjusting the flow of pressurized fluid passing into the manifold. The individual metering valves are adjusted to balance the temperature of the heated fluid exiting from the inlet conduits into the manifold. A single temperature sensing device, located in the manifold, may then be used to adjust a uniform supply of power to all heater units, thereby maintaining a desired fluid temperature in the manifold.

8 Claims, 5 Drawing Figures

METHOD AND APPARATUS FOR TEMPERATURE CONTROL OF HEATED FLUID IN A FLUID HANDLING SYSTEM

This invention relates to method and apparatus for maintaining uniform temperatures in a pressurized heated fluid handling device, and, more particularly, to an improved method and apparatus for maintaining uniform temperature in pressurized heated fluid distributed from an elongate manifold in one or more pressurized streams to treat moving substrate materials to impart surface effects therein.

BACKGROUND OF THE INVENTION

It is generally known to employ apparatus to direct pressurized heated fluid, such as air or steam, into the surface of a moving textile pile fabric to alter location of and/or modify the thermal properties of fibers or yarns contained therein and provide a change in the surface appearance of the fabrics. U.S. Pat. Nos. 2,241,222; 3,010,179 and 3,585,098 disclose apparatus for treating yarn and fiber-containing fabrics by directing a stream or plurality of streams of heated fluid onto the face of the moving fabric from an elongate heated fluid manifold which extends across the path of movement of the fabric.

When heated fluid, such as heated air or steam is applied to the surface of a fabric in one or more streams spaced along an elongate manifold, difficulties are encountered in maintaining uniform temperature of the stream or streams across the full width of the manifold. If pressurized heated fluid is introduced into the manifold from a single location along its length to be discharged from an elongate narrow slot or a plurality of openings extending along the length of the manifold, the varying distances of flow of the fluid through the manifold and from the source of heating of the fluid causes variable temperature losses in the fluid and resultant temperature differences in the fluid streams being discharged from the manifold. When the heat of the fluid in the streams is employed to thermally modify thermoplastic yarns and fibers in the fabrics to cause longitudinal shrinkage and molecular reorientation to produce a desired pattern in the fabric, differences in the temperatures of the streams striking the fabric can produce undesirable irregularities in the pattern applied thereto. It is therefore important to ensure that all streams striking the fabric be of substantially uniform temperature.

Copending commonly assigned Greenway U.S. patent application Ser. No. 103,329, filed Dec. 14, 1979, describes specific apparatus and method for the pressurized high temperature fluid treatment of a moving substrate, such as a textile fabric, with one or more streams of heated fluid discharged into the surface of the moving substrate from an elongate manifold. To provide for more uniform temperature control of the heated stream or streams across the full length of the manifold, pressurized heated fluid, such as air, is directed into the manifold through a plurality of air inlet conduits which communicate at spaced locations along the length of the manifold with the interior manifold compartment. Each of the air inlet conduits is provided with an individual heater, with the heaters and inlet conduits connected in parallel to deliver heated pressurized air into the manifold at uniformly spaced locations along its length. The temperature of air exiting each of the heaters is sensed and controls are provided to monitor and adjust the power supplied to the heaters to compensate for any variations in the heated air entering the manifold compartment from the individual inlet conduits. To individually monitor and continuously control power supplied to each individual heater to maintain exit air temperatures of the heaters uniform requires considerable electrical sensing, monitoring and control equipment, and involves considerable expense in the heat control system of the apparatus.

OBJECTS OF THE INVENTION

It is therefore an object of the present invention to provide improved method and apparatus for controlling the temperature of heated fluid in and discharged from an elongate fluid distributing manifold utilizing multiple inlet conduits with heater units to heat the incoming fluid.

It is another object to provide improved method and apparatus for establishing uniform outlet fluid temperatures from a bank of individual heaters arranged in parallel to heat pressurized fluid passing therethrough into an elongate manifold compartment.

It is a further more specific object to provide a simplified and economical method and apparatus for controlling the exit fluid temperatures from a bank of plural individual heaters connected in parallel along the length of a fluid distributing manifold by incrementally adjusting fluid flow through the heaters to balance the exit temperatures, and thereafter sensing and controlling the temperatures from a single sensing point along the manifold.

It is still a further object to provide valve means in the heated fluid inlet conduits to a heated fluid manifold discharge device whereby flow of pressurized fluid through individual heaters of a bank of heaters associated therewith may be regulated by incremental amounts to balance the exit fluid temperatures at a given common power level input of energy to the bank of heaters, thereby eliminating the need to individually sense, monitor and regulate power input of each heater to maintain uniform temperatures during the fluid treatment operation.

It is a further object to provide improved apparatus for treating a moving substrate surface with a stream or streams of heated fluid directed into the surface as the substrate is supported in its movement by passage over a rotatable roller, and wherein a heat-transfer fluid is circulated through the roller to prevent warping or distorting of the roller due to non-uniform heating of its surface by contact with the heated fluid stream or streams.

BRIEF DESCRIPTION OF THE DRAWINGS

The above, as well as other objects of the invention will become more apparent, and the invention will be better understood by reference to the following detailed description of preferred embodiments of the invention when taken together with the accompanying drawings in which.

BRIEF DESCRIPTION OF THE PRESENT INVENTION

In its broad aspects, the present invention is directed to improved method and apparatus for controlling energy supplied to a plurality of individual heaters located to direct heated pressurized fluid into uniformly spaced locations along the compartment of an elongate heated fluid distributing manifold to maintain uniform temperature of the heated fluid along the length of the manifold. More particularly, pressurized ambient fluid, such as air, is supplied to each heater through individual conduits, each containing a fluid flow metering valve for independently and precisely regulating fluid flow through each heater. The heaters are connected electrically in parallel to a common power supply, and temperature sensing means, such as a thermocouple, is located in or adjacent the heated fluid outlet of each heater into the manifold compartment. Each thermocouple is connected to a temperature recorder where the individual fluid outlet temperature of each heater may be observed. A single thermocouple senser located centrally in the fluid distributing manifold is operatively connected to a power control regulator in the common power supply line to the heaters. When pressurized fluid and power are initially supplied to each heater unit, the individual fluid outlet temperatures of each heater are observed and any variations in such temperatures are precisely balanced to a common temperature by incremental adjustment of the fluid flow through one or more of the heaters by use of the aforementioned metering valves. Thus, when the heater outlet fluid temperatures are uniformly balanced, the temperature in the manifold compartment may be thereafter sensed at a single location along its length to regulate power supply uniformly and simultaneously to all heaters.

With the ability to incrementally adjust fluid flow through each heater to uniformly balance exit fluid temperatures therefrom, it becomes unnecessary to thereafter individually monitor and separately control power supplied to each heater to maintain uniform temperature across the length of the manifold.

The present invention also provides means for circulating a heat transfer fluid through a support roll positioning a moving substrate adjacent the heated fluid-distributing manifold for contact by the heated fluid streams. The heat transfer fluid provides uniform transfer of heat about the surface of the roll and precludes warping or distortion of the roll during treating operations due to uneven heating of the surface of the roll by localized contact with the heated fluid treating medium.

DETAILED DESCRIPTION OF EMBODIMENTS OF THE INVENTION

Figure 1:
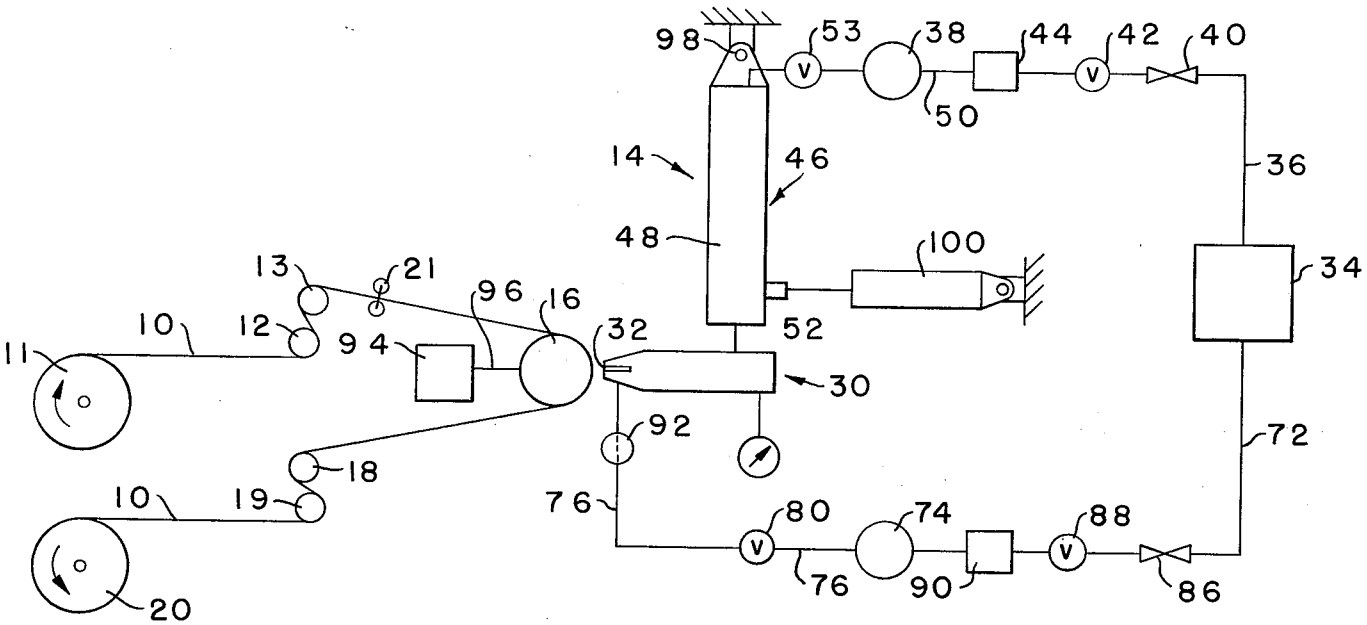
FIG. 1 is a schematic, overall side elevation view of apparatus for high temperature fluid treatment of a moving web of material, and incorporating temperature control features of the present invention.

Referring more particularly to the drawings, which illustrate a preferred embodiment of apparatus of the present invention, FIG. 1 is a schematic side elevation view of the overall heated fluid treating apparatus. As shown diagrammatically, an indefinite length of substrate material, such as a textile fabric 10, is continuously directed from a supply source, such as roll 11, by means of driven, variable speed feed rolls 12, 13 to a pressurized heated fluid treatment device, indicated generally at 14. The moving fabric 10 is supported during application of heated fluid thereto by passage about a rotatable support roll 16, and the fluid-treated fabric is thereafter directed by driven, variable speed take-off rolls 18, 19 to a fabric collection roll 20.

A conventional fabric edge-guiding device 21, well known in the art, may be provided in the fabric path between feed rolls 12, 13 and the fluid treating device 14 to maintain proper lateral alignment of the fabric during its passage over support roll 16. The speed of the feed rolls 12, 13 support roll 16, and take-off rolls 18, 19 may be controlled, in known manner, to provide the desired speed of fabric travel and the desired tensions in the fabric entering, passing through, and leaving the fluid treating device 14.

Figure 2:
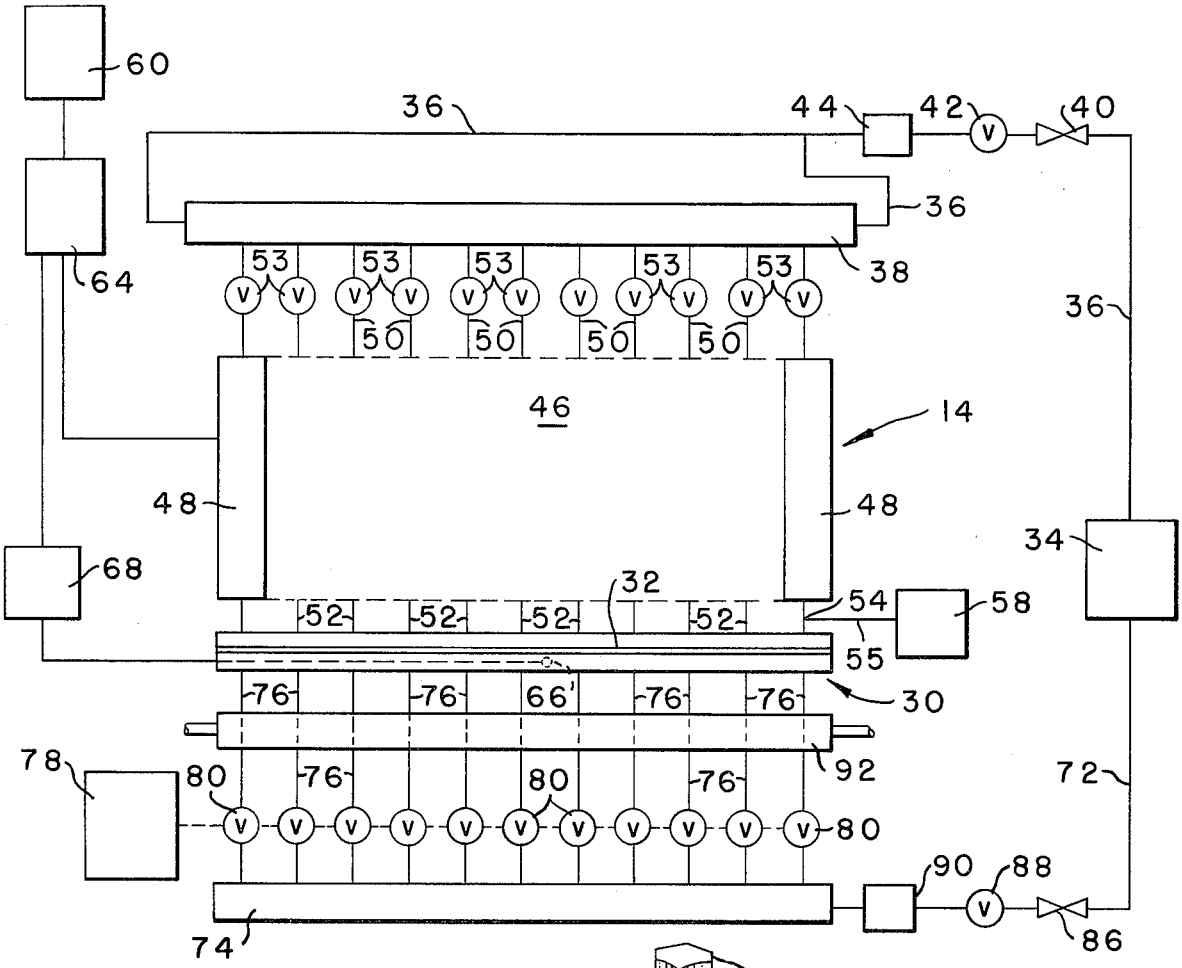
FIG. 2 is a schematic front elevation view of a portion of the apparatus of FIG. 1, and showing the arrangement of the heated fluid distributing manifold and its associated heater units.

As illustrated in FIGS. 1 and 2, the pressurized heated fluid treating device 14 includes an elongate heated fluid discharge manifold 30 which extends perpendicularly across the path of movement of fabric 10 and has a narrow, elongate discharge slot 32 for directing a stream of pressurized heated fluid, such as heated air, onto the surface of the fabric and at an angle generally perpendicular to its surface during its movement over support roll 16.

Pressurized air is supplied to the interior of the discharge manifold 30 by means of an air compressor 34 which is connected by air conduit line 36 to opposite ends of an elongate cool air manifold, or header pipe, 38. Located in the air conduit line 36 to control the flow and pressure of air to manifold 38 is a master control valve 40, and an air pressure regulator valve 42. A suitable air filter 44 is also provided to assist in removing contaminants from the air passing into cool air manifold 38.

Pressurized air in the cool air manifold 38 is directed from manifold 38 to the interior compartment of hot air discharge manifold 30 through a bank 46 of individual electric heaters, two of which, 48, are illustrated in FIG. 2. Each heater is connected by inlet and outlet conduits 50, 52 respectively, positioned in uniformly spaced relation along the lengths of the two manifolds 38, 30 to heat and uniformly distribute the pressurized air from manifold 38 along the full length of the discharge manifold 30. Typically, for a 60 inch long discharge manifold, 24 one kilowatt electric heaters, with heater outlet conduits 52 spaced on $2\frac{1}{2}$ inch centers along the length of the manifold, may be employed in the heater bank 46. The bank of heaters 46 may be enclosed in a suitable insulated housing.

Located in each inlet conduit 50 to each heater 48 in the heater bank is a manually adjustable fluid-flow metering valve 53 to precisely control the rate of flow of pressurized air from header pipe 38 through each of the respective heaters 48. Typically, the valves may be of needle valve type for precise flow control, and the use thereof will be hereinafter explained.

Positioned in the air outlet conduit 52 of each heater is a temperature sensing device, such as a thermocouple, the position of only one of which, 54, has been shown in FIG. 2, to measure the temperature of the outflowing air from each heater. Each of the thermocouples 54 are electrically connected by suitable wiring (illustrated by lines 55 in FIGS. 2 and 3) to a conventional electrical chart recorder 58 where all air temperatures in the heater outlet conduits can be observed and monitored visually or by audible signal. Electric current is uniformly supplied, as required, to all individual heaters from a common power source, generally indicated at 60.

Figure 3:
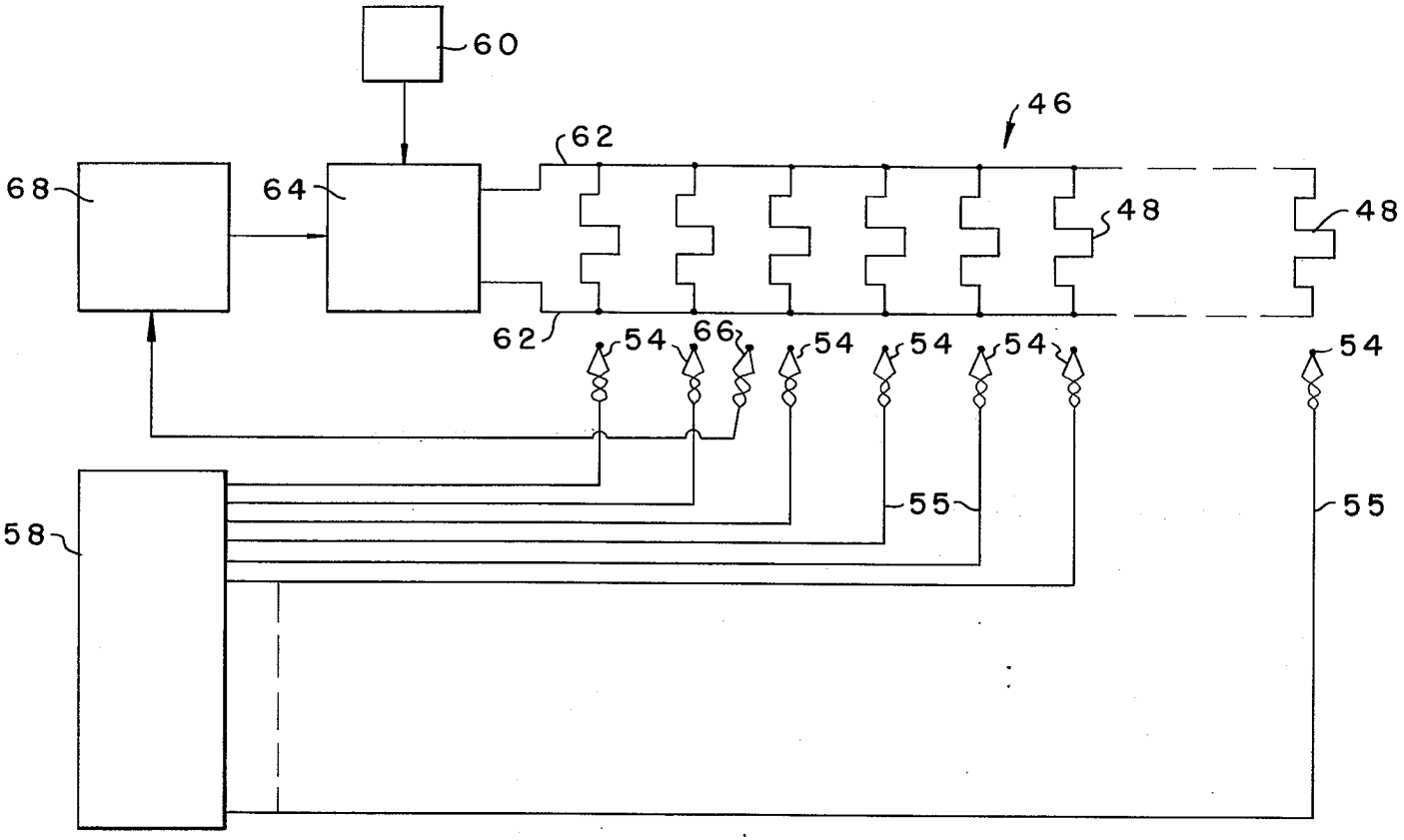
FIG. 3 is a schematic block wiring diagram indicating the manner in which electrical energy is supplied to the bank of heaters of FIGS. 1 and 2 to control the temperatures of pressurized fluid supplied therefrom to the heated fluid distributing manifold.

As illustrated in FIG. 3, the electrical heaters 48 are connected in parallel by suitable electrical wiring 62 to common main power supply 60. Located in the main power supply line to the individual heaters 48 is a conventional power controller 64, such as a silicon controlled rectifier Model 7301 manufactured by Electronic Control Systems. Located in the interior compartment of elongate manifold 30 at a mid portion along its length is a temperature sensing device, or thermocouple 66 (FIG. 3), which is electrically connected to a conventional temperature controller 68, such as a Model 6700 control unit manufactured by Electronic Control Systems. The temperature controller 68 is electrically connected in known manner to the power controller 64 such that a desired temperature may be maintained in the compartment of the discharge manifold 30 by a periodic supply of uniform electrical energy to the heaters 48 of the heater bank 46.

Figure 4:
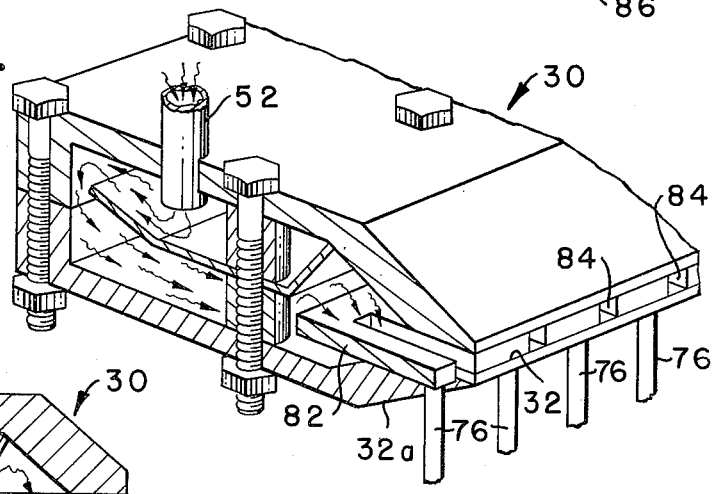
FIG. 4 is an enlarged schematic perspective view of a portion of the heated fluid distributing manifold of FIGS. 1 and 2; with a portion thereof shown in section to better illustrate the interior compartment thereof.
Figure 5:
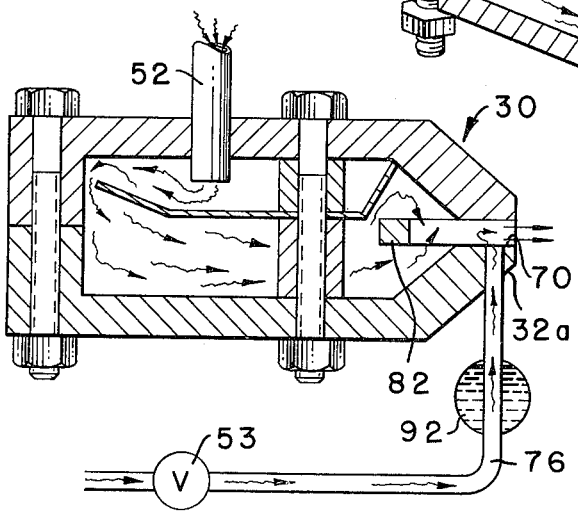
FIG. 5 is a sectional side elevation view of the portion of the manifold shown in FIG. 4.

As schematically illustrated in FIGS. 1, 2, 4 and 5, and as explained in greater detail in said Greenway copending application Ser. No. 103,329, the elongate discharge slot 32 of the heated fluid discharge manifold 30 may be provided with a plurality of pressurized cooler air discharge outlets (one of which 70 is seen in FIG. 5) located in spaced relation in the lower wall portion 32*a* of the discharge slot 32 of the manifold 30. Pressurized cool air is supplied to each outlet 70 from compressor 34 by way of a main conduit 72 (FIGS. 1 and 2), header pipe 74, and conduits 76. Supply of cooler pressurized air to the outlets 70 is controlled in accordance with pattern information from a pattern control device 78 which operates a solenoid valve 80 (FIGS. 1, 2 and 5) located in each conduit 76. As pressurized cooler air is discharged from selected of the outlets 70 in accordance with pattern information, the cool pressurized air passes into and across the width of the discharge slot 32 to selectively block one or more areas of the heated air stream from passing through the slot and into the surface of the substrate. Thus, the cooler pressurized air is effectively utilized to divide the pressurized heated air being discharged from slot 32 into a plurality of discrete streams which strike the surface of the moving substrate in spaced locations to provide a desired pattern therein.

Patterning of the moving substrate by heated fluid stream contact may also be accomplished by the use of a notched shim plate, either alone or in combination with the pressurized cool air patterning means. As best seen in FIGS. 4 and 5, a thin plate 82 having a notched edge may be located in the manifold slot 32 such that the notches cooperate with upper and lower walls of the slot to define a plurality of discharge channels 84 spaced along the length of the manifold for discharge of pressurized heated fluid streams into the substrate to pattern the surface thereof. As mentioned, the shim plate may be employed without the use of cooler air control means, or the cooler air control means may be employed without the shim plate to selectively direct the streams of heated fluid, all in accordance with the details disclosed in said copending application. Main cool air conduit 72 may also be provided with master control valve 86, pressure regulator valve 88, and air filter 90 (FIGS. 1 and 2). The pressurized cool blocking air may be further cooled positively by passage of conduits 76 through a cooling water manifold pipe 92 before discharge in the manifold slot 32.

The operation of the improved temperature control means of the present invention may best be described and understood as follows. In initial start up of the fluid treating apparatus, electrical power is supplied uniformly to the heaters 48 of the heater bank 46 from power supply source 60 and pressurized air is passed through the heaters from the air compressor 34. The temperature controller unit 68 is set at a selected temperature. When the air temperature in the discharge manifold compartment, as measured by thermocouple 66, reaches the desired temperature setting, the individual exit air temperatures in the exit air conduit from each of the individual heaters are observed on the chart recorder 58. In the event that there is any temperature difference between any one or more of the individual heater exit air temperatures observed on the chart recorder 58, the needle control metering valve 53 of the heater unit or units in which a discrepancy is observed is manually adjusted by an incremental amount to increase or decrease the flow of air through the heater, thereby correspondingly decreasing or increasing the temperature of the air exiting from the individual heater. Thus, the individual exit air temperatures from the entire bank of heaters can be precisely "balanced" by incremental adjustment of the air flow therethrough to a uniform temperature, thereby compensating for heater manufacturing tolerance variations or minor flow variations in heaters in the fluid flow system. Thereafter, a uniform temperature may be maintained throughout the entire length of the discharge manifold compartment by adjusting the supply of power to all heaters uniformly through the single thermocouple sensor 66 centrally located in the manifold compartment.

The present invention also includes apparatus for circulating a heat transfer fluid through the interior of the rotatable support roll 16 (FIG. 1) about which the continuous length of substrate passes during contact by the heated fluid from fluid distributing manifold 30. As can be appreciated, when the pressurized heated fluid stream or streams strike the surface of the substrate to thermally modify and provide a desired visual change therein, the heated fluid also heats the underlying adjacent surface portion of support roll 16. Such localized heating of the support roll can produce differential thermal expansion and contraction of the roll along its length, particularly when the moving substrate may be temporarily stopped during the processing operations. Such differential expansion and contraction of support roll 16 can produce warping and distortion of the roller surface adjacent the discharge slot 32 of the manifold 30, causing the fabric substrate supported thereon to be positioned at different distances from the discharge slot 32 along the length of the slot and resulting in irregular patterning of the substrate due to temperature and pressure differences of the heated fluid streams striking the substrate surface.

To prevent such bowing or distortion and consequent irregular patterning of the substrate surface, means are provided for circulating a fluid heat transfer medium through the rotating roll 16 during fluid treating operations. As seen in FIG. 1, a suitable fluid, such as cooled or heated water, steam, or the like is circulated into and from the interior of roll 16 from a suitable supply source, indicated generally at 94, through conduit means 96 connected to the central hollow support shaft of the roll. Apparatus for circulating fluid through a revolving roll from a stationary fluid supply source are well known and commercially available in the art, and details thereof will not be described herein. Typically, such circulating apparatus may be of the type manufactured under the trade name 8000 Series Rotary Union Joints, distributed by Duff-Norton Company, of Charlotte, N.C.

As indicated, the heat transfer fluid may be cool water, or it could be a heated fluid such as steam or hot water, if it is desired, to facilitate overall heating of the substrate during fluid treatment operations. The heat transfer fluid circulating through the interior of the rotatable roller 16 thus uniformly distributes the localized heating of the surface of roll 16 adjacent manifold discharge slot 32 throughout the entire periphery of the roll, thus preventing the aforesaid differential thermal expansion and contraction of the roll during treating operations.

To prevent possible damage to the substrate during periods in which the substrate material is stopped, the heat distributing manifold 30 and associated heater bank 46 also may be pivotally mounted, as at 98, and fluid piston means 100 utilized to pivot the manifold 30 away from the surface of the substrate, as desired.

That which we claim is:

1. Apparatus for directing at least one stream of pressurized, heated fluid in a desired direction while maintaining generally uniform temperature in the heated fluid stream, comprising a manifold defining an elongate compartment for receiving pressurized heated fluid and including outlet means for directing heated fluid outwardly therefrom in at least one stream disposed along the length of the manifold compartment; a plurality of fluid inlet conduits respectively communicating with said manifold compartment at generally uniformly spaced locations along the length thereof; an individual heater associated with each of said fluid inlet conduits to heat fluid passing therethrough; means for supplying energy generally uniformly to each heater to heat the same; temperature determining means associated with each of said inlet conduits for determining the temperature of the heated fluid adjacent the location of communication of each of said inlet conduits with said compartment; and valve means in each inlet conduit for incrementally adjusting the flow of fluid through each inlet conduit and its associated heater to thereby regulate the temperature of the fluid in said spaced locations along said manifold compartment and establish a uniform temperature of the fluid along the length of the compartment as determined by said temperature determining means.

2. Apparatus as defined in claim 1 wherein said means for determining the temperature of the heated fluid comprises a temperature sensing device disposed in the flow of fluid adjacent each said location of communication of an inlet conduit with said manifold compartment, and temperature indicator means connected thereto for observing the temperature of the heated fluid sensed by each sensing device.

3. Apparatus as defined in claim 1 wherein each of said valve means comprises a needle valve in each of said conduits located upstream of said heater associated therewith.

4. Apparatus as defined in claim 1 wherein said means for supplying energy to each heater comprises an energy source, means for sensing the temperature of the heated fluid at a single location along said manifold compartment, and means for uniformly adjusting the supply of energy to all of said heaters in response thereto.

5. Apparatus as defined in claim 4 wherein each of said heaters comprises an electrically powered heater unit having a fluid inlet, a fluid outlet, and a fluid passageway therethrough, and an electrical heating element surrounding said passageway to heat fluid passing through said heater unit.

6. Apparatus as defined in claim 1 including a cool fluid manifold defining an elongate manifold compartment for receiving pressurized relatively cool fluid therein, and each of said fluid inlet conduits communicating with said cool fluid manifold compartment at uniformly spaced locations along its length to receive pressurized cool fluid for uniform distribution to said heated fluid manifold compartment.

7. An improved method for maintaining uniform temperature of pressurized heated fluid distributed from an elongate manifold compartment in at least one stream disposed along the length of the manifold compartment, comprising the steps of:

(a) directing pressurized fluid into the elongate interior compartment of a manifold through a plurality of inlet conduits, and individual heaters associated therewith, which conduits communicate with the elongate manifold at spaced locations along its length;

(b) supplying energy to each of the heaters at a uniform rate to heat the pressurized fluid passing therethrough;

(c) determining the temperature of the heated fluid passing into the manifold compartment adjacent each location of introduction of pressurized fluid from said conduits;

(d) incrementally adjusting the flow of heated fluid through selected ones of said inlet conduits and associated heaters in response to said temperature determinations to establish a uniform temperature in the pressurized heated fluid passing into said compartment along its length; and thereafter (e) sensing the heated fluid temperature supplied to said manifold compartment at a single location along its length and controlling the energy uniformly supplied to each of said heaters in response thereto to maintain the temperature of the fluid in the compartment at a desired temperature level.

8. A method as defined in claim 7 wherein said pressurized fluid passing through said inlet conduits and heaters is incrementally adjusted by manual adjustment of a control valve located in each inlet fluid conduit.

* * * * *